US009486036B1

(12) United States Patent
Douglas

(10) Patent No.: US 9,486,036 B1
(45) Date of Patent: Nov. 8, 2016

(54) SHOE AND METHOD OF MANUFACTURE

(71) Applicant: Michael K. Douglas, Eatontown, NJ (US)

(72) Inventor: Michael K. Douglas, Eatontown, NJ (US)

( * ) Notice: Subject to any disclaimer, the term of this patent is extended or adjusted under 35 U.S.C. 154(b) by 0 days.

(21) Appl. No.: 14/976,035

(22) Filed: Dec. 21, 2015

(51) Int. Cl.

| | |
|---|---|
| ***A43B 13/28*** | (2006.01) |
| ***A43B 13/38*** | (2006.01) |
| ***A43B 23/00*** | (2006.01) |
| ***A43B 23/20*** | (2006.01) |
| ***A43B 23/02*** | (2006.01) |
| ***A43B 13/12*** | (2006.01) |

(52) U.S. Cl.
CPC ..... *A43B 13/38* (2013.01); *A43B 13/12* (2013.01); *A43B 13/28* (2013.01); *A43B 23/0245* (2013.01)

(58) Field of Classification Search
CPC ..... A43B 13/28; A43B 13/36; A43B 13/38; A43B 3/246; A43B 23/0245; A43B 13/12; A43B 13/122; A43B 13/125; A43B 13/127; A43C 15/161
USPC ..... 36/12, 15, 19 R, 24, 43, 59 A, 103
See application file for complete search history.

(56) References Cited

U.S. PATENT DOCUMENTS

| | | | | |
|---|---|---|---|---|
| 84,650 A | | 12/1868 | Shepard | |
| 2,183,277 A | | 12/1939 | Heilhecker | |
| 3,019,534 A | * | 2/1962 | Kauffman | A43B 13/36 36/15 |
| 3,538,628 A | | 11/1970 | Einstein, Jr. | |
| 4,317,294 A | | 3/1982 | Goodyear | |
| 4,349,970 A | * | 9/1982 | Silver | A43B 13/28 36/12 |
| 4,420,894 A | | 12/1983 | Glassman | |
| 4,606,139 A | * | 8/1986 | Silver | A43B 13/36 36/100 |
| 5,317,822 A | | 6/1994 | Johnson | |
| 5,598,644 A | * | 2/1997 | Polegato | A43B 7/125 36/3 B |
| 5,657,556 A | | 8/1997 | Bemis | |
| 5,802,738 A | | 9/1998 | Ferniani | |
| 5,822,888 A | | 10/1998 | Terry | |
| 6,789,334 B2 | | 9/2004 | Wu | |
| 6,904,705 B2 | * | 6/2005 | Polegato Moretti | A43B 7/06 36/11 |
| 6,915,596 B2 | * | 7/2005 | Grove | A43B 13/223 36/100 |
| 6,948,261 B1 | * | 9/2005 | Grasso | A43B 5/18 36/100 |
| 7,234,248 B2 | | 6/2007 | Kelley | |
| 7,254,905 B2 | * | 8/2007 | Dennison | A43B 7/18 36/15 |

(Continued)

FOREIGN PATENT DOCUMENTS

| | | | |
|---|---|---|---|
| WO | WO 94/15493 | 7/1994 | |
| WO | WO 2009091988 A1 * | 7/2009 | A43B 1/0027 |

OTHER PUBLICATIONS

Photographs believed to correspond to an example of the prior art sandal disclosed in Figs. 1 and 2 of US 2009/0044423.

*Primary Examiner* — Anna Kinsaul
*Assistant Examiner* — Jameson Collier
(74) *Attorney, Agent, or Firm* — Lawrence B. Goodwin, P.C.

(57) ABSTRACT

A shoe, and method of manufacture, including (i) a shoe upper having an arrangement of holes in the bottom surface, (ii) an outer sole having an arrangement of holes corresponding to the arrangement of holes in the bottom surface of the shoe upper, and (iii) an inner sole disposed within the shoe upper, the inner sole having a plurality of pegs that extend from its bottom surface that are arranged in alignment with the arrangement of holes in the shoe upper and outer sole when the inner sole is disposed within the shoe upper, each peg extending downwardly through its associated hole in the shoe upper and the outer sole, so that, in the preferred embodiment, the bottom surface of each peg is exposed to, and forms part of, bottom surface of the shoe.

20 Claims, 7 Drawing Sheets

(56) References Cited

U.S. PATENT DOCUMENTS

| | | | | |
|---|---|---|---|---|
| 7,406,781 | B2 * | 8/2008 | Scholz | A43B 3/24 36/134 |
| 7,721,466 | B2 | 5/2010 | Guo | |
| 7,793,428 | B2 * | 9/2010 | Shenone | A43B 1/0072 36/25 R |
| 8,307,570 | B2 | 11/2012 | Delgatty | |
| 2002/0178620 | A1 * | 12/2002 | Asciolla | A43B 13/36 36/132 |
| 2005/0034332 | A1 | 2/2005 | Moschel et al. | |
| 2005/0268491 | A1 * | 12/2005 | McDonald | A43B 1/0063 36/28 |
| 2009/0044423 | A1 | 2/2009 | Amsterdam | |

* cited by examiner

SHOE AND METHOD OF MANUFACTURE

The present invention relates to a new and improved shoe and a novel method of manufacture that is more efficient, less costly and safer than the prior art.

BACKGROUND OF THE INVENTION

Shoe manufacturers strive to produce products that are comfortable, lightweight, sturdy, durable, shock absorbent and breathable, yet inexpensive. Incorporating all of these characteristics in a single shoe, however, has been difficult to achieve without employing manufacturing techniques that are expensive, labor intensive and time-consuming, and which sometimes employ hazardous manufacturing materials and methods, such as the use of glues or sealants, which may produce toxic fumes and which require time-consuming cooling during manufacture.

Simpler manufacturing techniques, such as those employed in the manufacture of "flip-flops" (an example of which is disclosed in publication number US 2009/0044423 to Amsterdam) result in reduced manufacturing costs but do not produce a "shoe," as opposed to a simple beach sandal or the like, which has limited durability and practical use.

SUMMARY OF THE INVENTION

It is therefore an object of the present invention to produce a relatively high-quality shoe and a novel method of manufacture that is more efficient, less costly and safer than the prior art.

Briefly, the shoe produced in accordance with the preferred embodiment of the present invention includes a shoe upper having an arrangement of holes in the bottom surface, an outer sole having an arrangement of holes corresponding to the arrangement of holes in the bottom surface of the shoe upper, and an inner sole disposed within the shoe upper, the inner sole having a plurality of pegs that extend from its bottom surface that are arranged in concentric alignment with the arrangement of holes in the shoe upper and outer sole when the inner sole is disposed within the shoe upper. In accordance with the preferred embodiment, each peg extends downwardly through its associated hole in the shoe upper and the outer sole, so that the bottom surface of each peg is exposed to the bottom surface of the shoe. Preferably, the bottom surface of each peg is substantially coplanar with the bottom surface of the outer sole. Alternatively, a supplemental outer sole, made from a material similar to the material of the outer sole, may be applied to the bottom surface of the outer sole, if desired.

In accordance with the preferred embodiment, the outer sole and inner sole, including the pegs, are formed of resilient, deformable material. Each peg is configured substantially in the shape of an inverted "T", and each hole in the outer sole contains a recess that is configured to closely accommodate the configuration of each peg, so that each peg fits snugly within its associated recess. Preferably, each peg and its associated recess have substantially circular cross sections, but other cross sections, such as square, for example, may be used as well.

Various materials preferred for the shoe upper, the inner sole and the outer sole are disclosed, and the materials can be chosen so that the sole, formed by the outer sole and the pegs, can have a substantially uniform surface. The outer sole may be die-cut or molded.

The method for manufacturing a shoe in accordance with the preferred embodiment of the present invention includes the steps of inserting an inner sole having a plurality of pegs extending from its bottom surface into a shoe upper having an arrangement of holes in its bottom surface corresponding to the arrangement of the pegs, inserting each of the plurality of pegs through its corresponding hole on the bottom surface of the shoe upper, providing an outer sole having an arrangement of holes corresponding to the arrangement of holes in the bottom surface of the shoe upper, and inserting each of the plurality of pegs through a corresponding hole in the outer sole, wherein after inserting each of the plurality of pegs through a corresponding hole in the outer sole, the bottom surface of each peg is exposed to and forms part of the bottom surface of the shoe, and preferably is substantially coplanar with the bottom surface of the outer sole. Alternatively, the method may also include the step of applying a supplemental outer sole to the bottom surface of the outer sole.

The resulting manufacture is a shoe that is comfortable, lightweight, sturdy, durable, shock absorbent and breathable, and which is produced using a manufacturing technique that is efficient, inexpensive, and does not require the use of toxic glues or sealants, resulting in production that is safer, more consistent, and which does not require a cooldown process. The resulting flexible inner sole/foot bed is shock absorbent, lightweight and comfortable and may be made of many different kinds of materials. The shoe produced in accordance with the present invention can employ an upper of any conventional style and have an appropriate pull strength to accommodate multiple activities and durability.

These and other objects and aspects of the present invention will be more fully described in accordance with the following detailed description.

DETAILED DESCRIPTION OF THE INVENTION

Figure 1A:
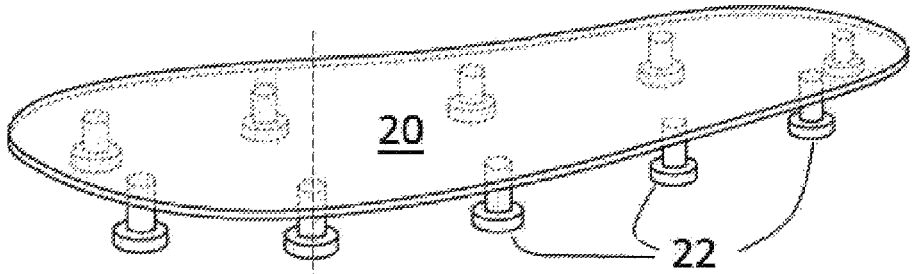
FIGS. 1A-1C are perspective views of the inner sole, upper and outer sole in accordance with the preferred embodiment of the present invention.
Figure 1B:
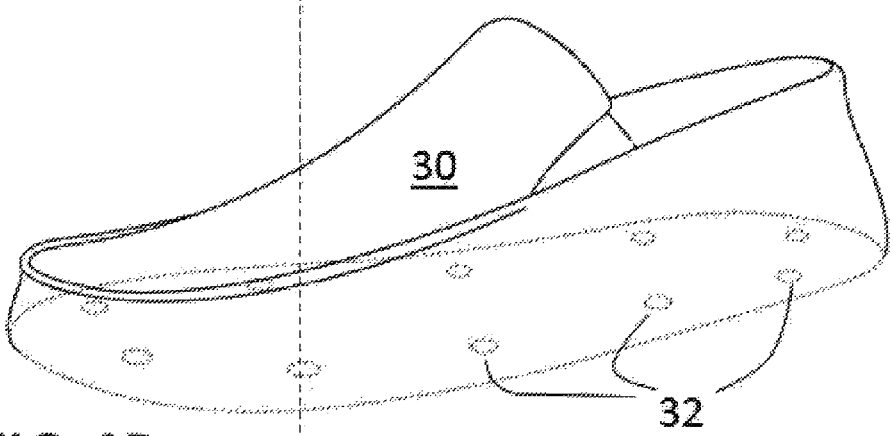
Figure 1C:
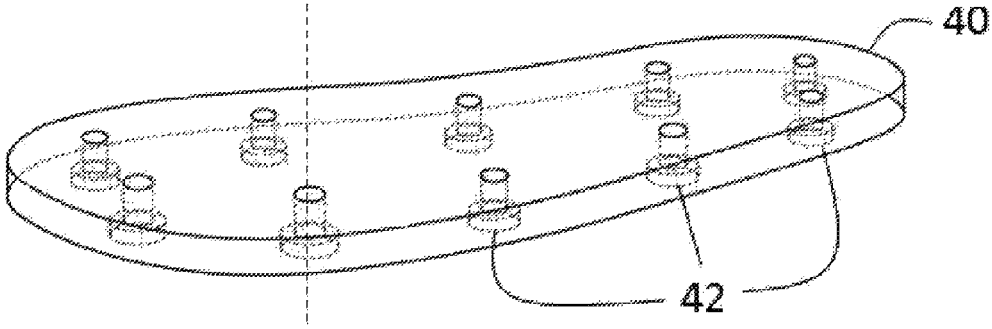

With reference to FIGS. 1A-1C, a shoe in accordance with the preferred embodiment of the present invention is manufactured with three basic components: an inner sole 20, an upper 30 and an outer sole 40. The inner sole 20 is provided with pegs or protrusions 22 extending downwardly from the bottom surface of the inner sole. The upper 30 is provided with a corresponding set of holes 32, and outer sole 40 is provided with a corresponding set of holes 42. As shown in the figures, the pegs 22, holes 32 and holes 42 are configured to be in concentric alignment, and the holes 32 and 42 extend completely through the upper 30 and outer sole 40 respectively. In the preferred embodiment, the upper 30, inner sole 20 and outer sole 40 are substantially co-extensive and substantially cover the entire sole, although separate heel and forefoot structures could be employed, if desired. The outer sole has a width that extends from a medial sidewall of the shoe to a lateral sidewall of the shoe.

The particular arrangement of the pegs 22, and corresponding holes 32 and 42, can be as illustrated generally in the drawings, but variations can be made by those skilled in the art to accommodate different styles and sizes so that they can readily accommodate men, women and children, for different activities, as desired, and to avoid placing the pegs at flex and stress points, as may be necessary or desired.

Figures 2A, 2B, 2C, 2D:
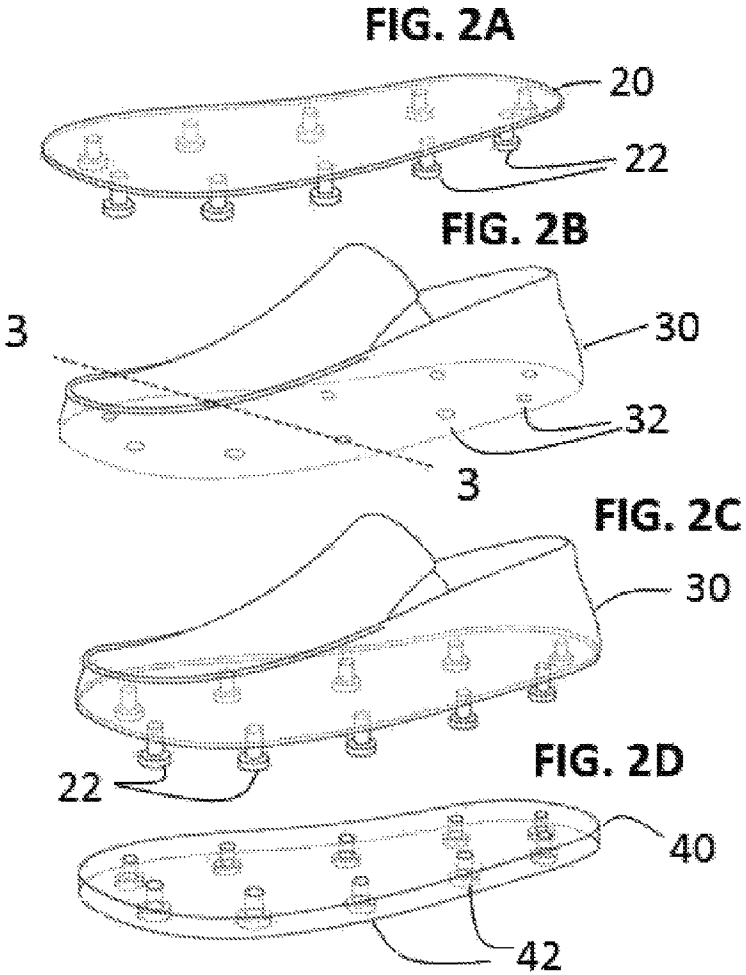
FIGS. 2A-2D are perspective views of the preferred embodiment of the present invention showing the construction of the shoe, and the method of manufacture, in accordance with the present invention.
Figures 3A, 3B, 3C, 3D:
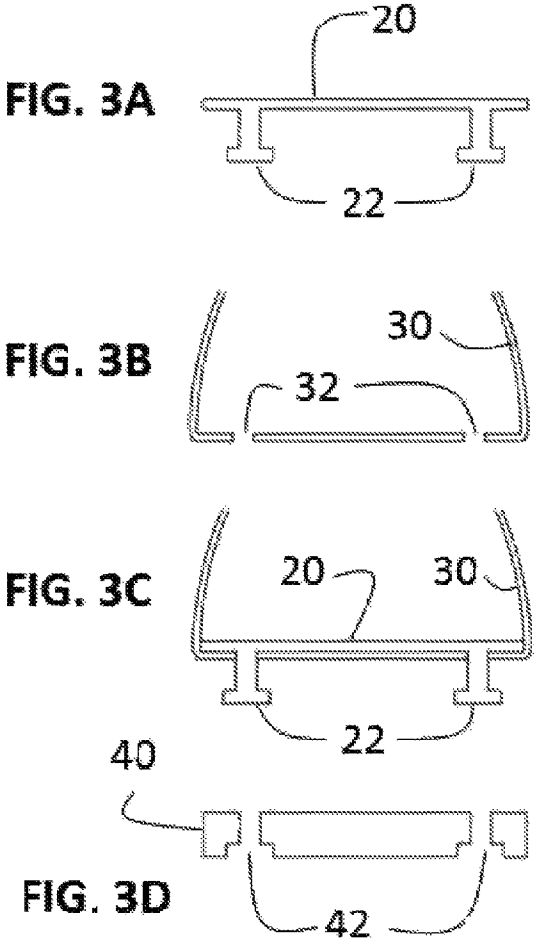
FIGS. 3A-3D show cross-sections taken through FIGS. 2A-2D, respectively.
Figure 4A:
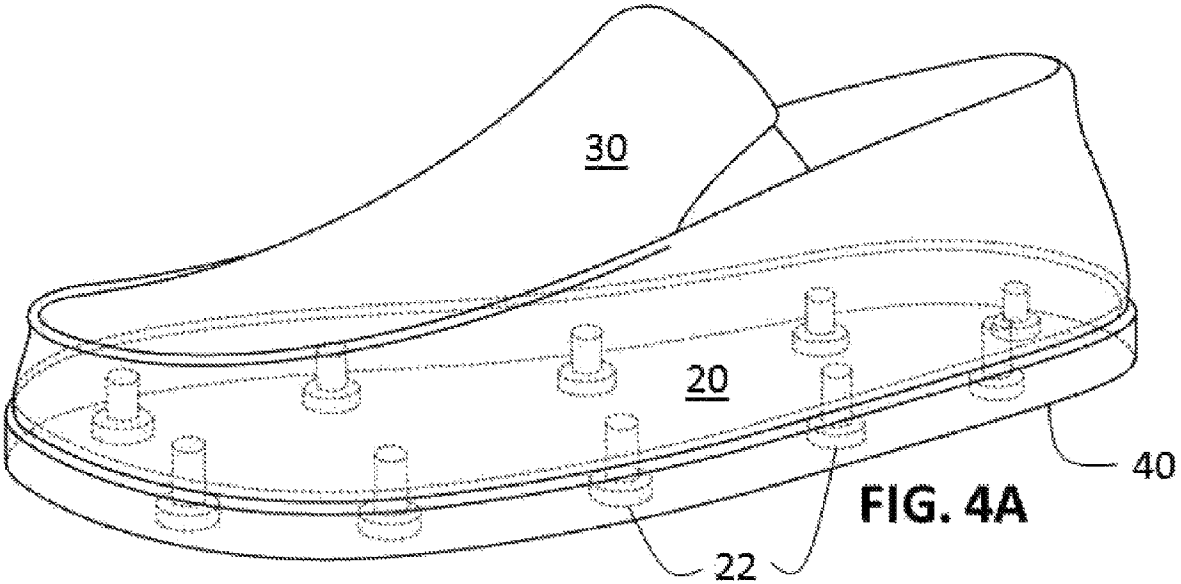
FIGS. 4A-4B illustrate details of the overall construction of the shoe in accordance with the preferred embodiment of the present invention, in perspective and in cross-section, respectively.
Figure 4C:
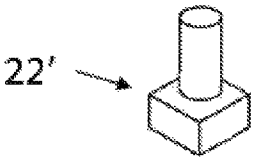
FIG. 4C illustrates an alternative peg.
Figure 4B:
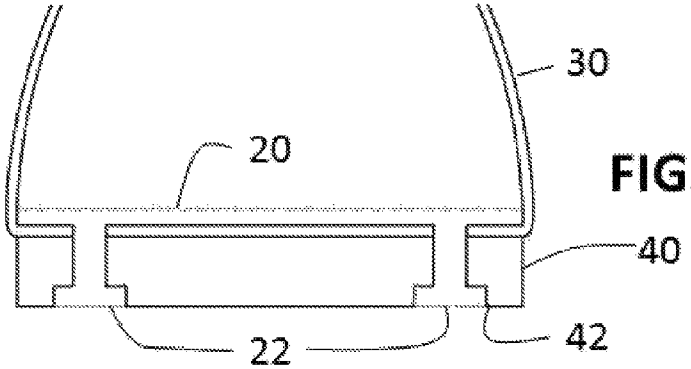
Figure 9:
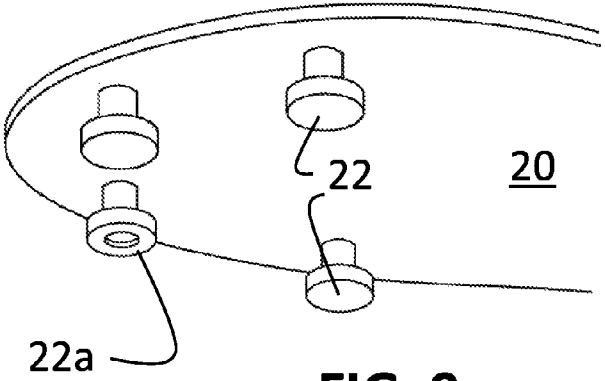
FIG. 9 illustrates another alternative peg.

The structure and method of construction of the shoe in accordance with the present invention are illustrated in connection with FIGS. 2A-2D and 3A-3D. The inner sole 20, shown in FIGS. 2A and 3A, is placed inside of upper 30, and the pegs 22 are inserted through each of their corresponding holes 32 in the upper 30, thereby resulting in the configuration shown in FIGS. 2C and 3C. The holes 32 in the upper 30 may be reinforced with an embroidery-like stitch around the edges of each hole, similar to dress shirt buttonholes. Such reinforcements can alternatively be of other conventional construction such as a heat-embossed plastic reinforcement rings, or other constructions that will be apparent to those skilled in the art. The shoe is finally assembled by inserting the pegs 22 through their corresponding holes 42 in the outer sole 40. As described below, one or more of the inner sole, outer sole and upper may be formed of resilient, deformable material, to thereby facilitate the insertion of the pegs 22 through the holes 32 and 42. The final assembly is shown in perspective in FIG. 4A and in cross-section in FIG. 4B. As best shown in FIG. 4B, and in accordance with the preferred embodiment of the invention, the bottom surface of each peg 22 is exposed to and forms part of the bottom surface of the shoe, and preferably, the bottom surface of each peg is substantially coplanar with the bottom surface of the outer sole 40, to produce a substantially uniform surface. It will be appreciated that the term "substantially co-planar" would encompass the shoe generally shown in FIG. 4B even if minor variations in the surface are employed, resulting from tread patterns or the like, or for example, an indentation in peg 22*a* shown in FIG. 9 for the insertion of a company logo or other mark.

In the preferred embodiment, each peg 22 is substantially cylindrical, having a circular cross-section, although other cross sections, such as square (an example of which is shown as peg 22' in FIG. 4C), may be used as desired. Each peg is generally configured in the shape of an inverted "T", although angular variations in the "T" shape (e.g., a slanted (italic) "T") are within the scope of the term "substantially inverted 'T' shape". Each hole 42 in the outer sole contains a recess on the bottom surface of the outer sole that is configured to closely accommodate the configuration of the peg 22, so that each peg fits snuggly within its associated recess. The use of resilient materials for one or more of the inner sole and outer sole will facilitate the snug fit between the pegs 22 and the recesses 42.

It will be appreciated that no glues or sealants are required in the construction of the preferred embodiment of the shoe, which is very beneficial, as described herein. Furthermore, and as explained in more detail below, the construction of the shoe, using the upper 30, inner sole 20 and outer sole 40 as shown in the figures, results in a shoe that can be manufactured very quickly and efficiently.

Figure 5A:
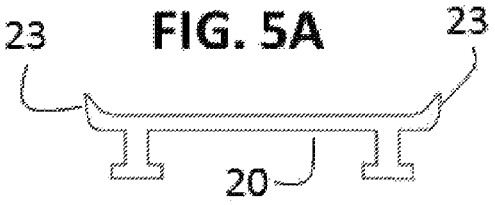
FIGS. 5A-5F illustrate alternative forms of the inner sole of the present invention.
Figure 5B:
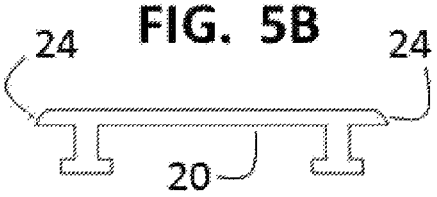
Figure 5C:
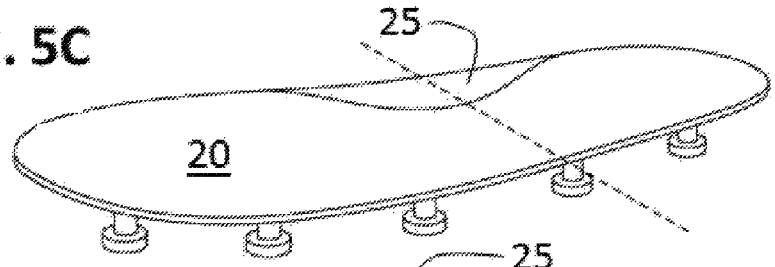
Figure 5D:
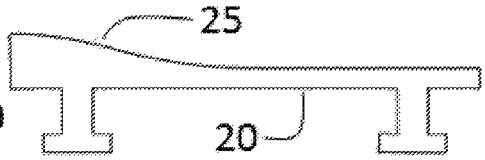
Figure 5E:
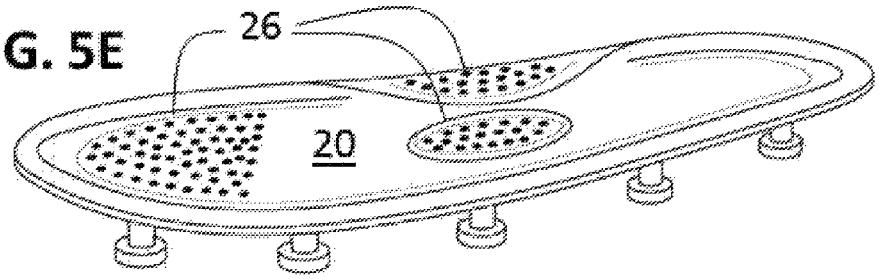
Figure 5F:
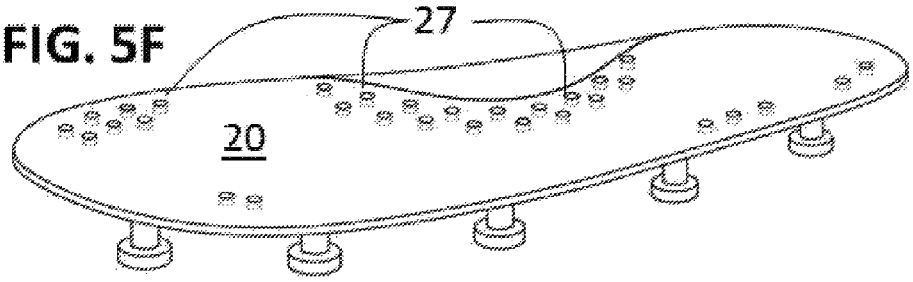

FIGS. 5A-5F show variations of the inner sole 20 which may be employed, if desired. For example, as shown in FIG. 5A, inner sole 20 can have cupped end portions 23 to accommodate different uppers, or for better fit or comfort. Similarly, as shown in FIG. 5B, inner sole 20 can be provided with a contoured edge 24 for better fit, comfort or to accommodate different uppers. As shown in FIG. 5C, and its associated cross-section FIG. 5D, the inner sole 20 can be provided with an arch support region 25. FIG. 5E illustrates a version of the inner sole 20 that has supportive contours and reflexology-inspired massage beads 26. Finally, FIG. 5F shows the use of perforated knockout holes 27 which may extend through the entire thickness of the inner sole 22 and provide for added breathability and lighter weight.

Figure 6A:
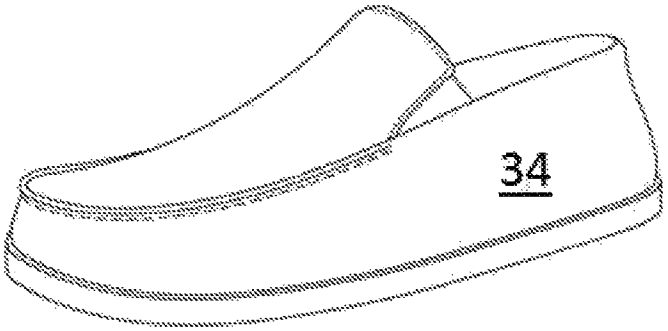
FIGS. 6A-6C illustrate shoes made in accordance with the present invention having different styles of uppers.
Figure 6B:
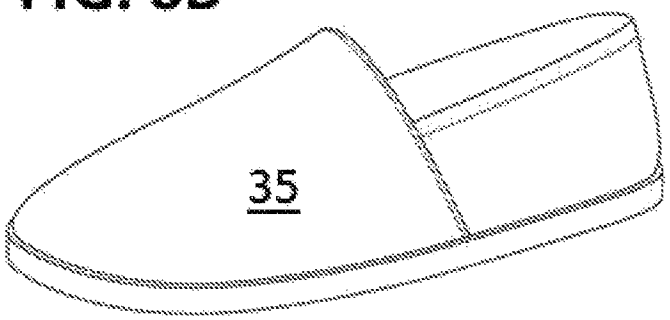
Figure 6C:
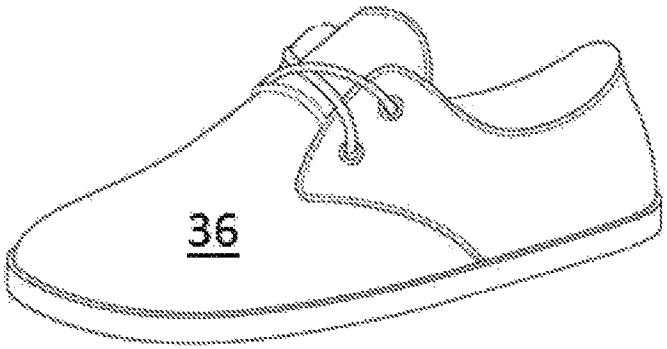

FIGS. 6A-C illustrate different uppers that can be made in accordance with the present invention. In particular, FIG. 6A illustrates a loafer 34, FIG. 6B illustrates a slipper 35, and FIG. 6C illustrates an Oxford 36. Additional styles of shoes can be used, as desired.

Figures 7A, 7B, 7C, 7D, 7E:
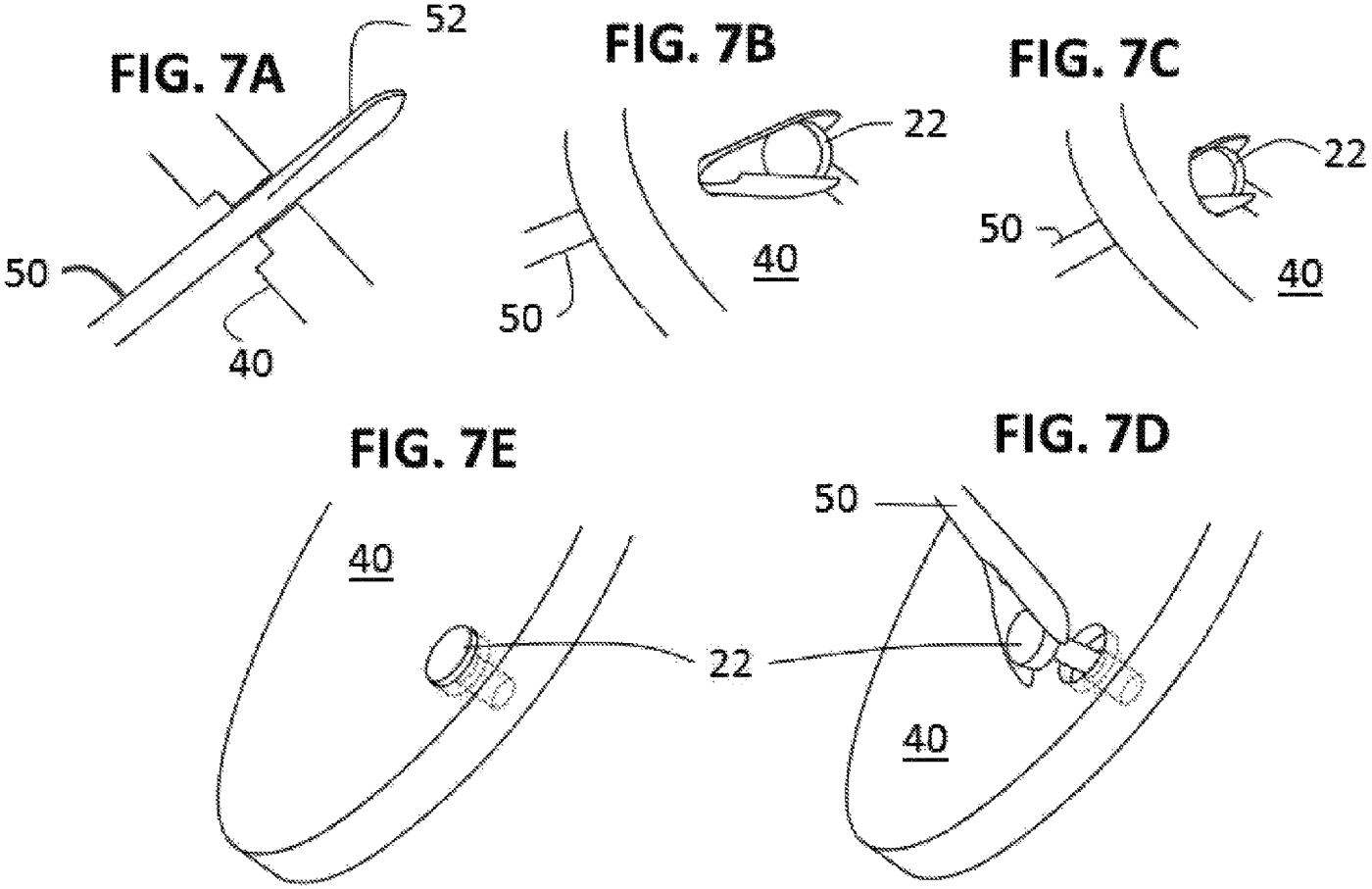
FIGS. 7A-7E illustrate a manufacturing technique for assembling the shoes in accordance with the present invention.

FIGS. 7A-7E illustrate a preferred method of manufacture of the shoe in accordance with the present invention. In particular, after pegs 22 are inserted through their associated holes in the bottom of the shoe upper (as described in connection with FIGS. 2A-2C), a tool 50, having gripping jaws 52, is inserted through the bottom side of hole 42 in outer sole 40, as shown in FIG. 7A. The gripping jaws 52 of the tool 50 open and grip the associated peg 22, as shown in FIG. 7B. The peg is then pulled through the hole 42 in the outer sole 40, as shown in FIGS. 7C and 7D, and then the tool is released, as shown in FIG. 7E. The process is repeated for each of the pegs 22 of the inner sole 20, until the shoe is completed. It will be appreciated that the foregoing method can be automated or implemented manually.

Figure 8A:
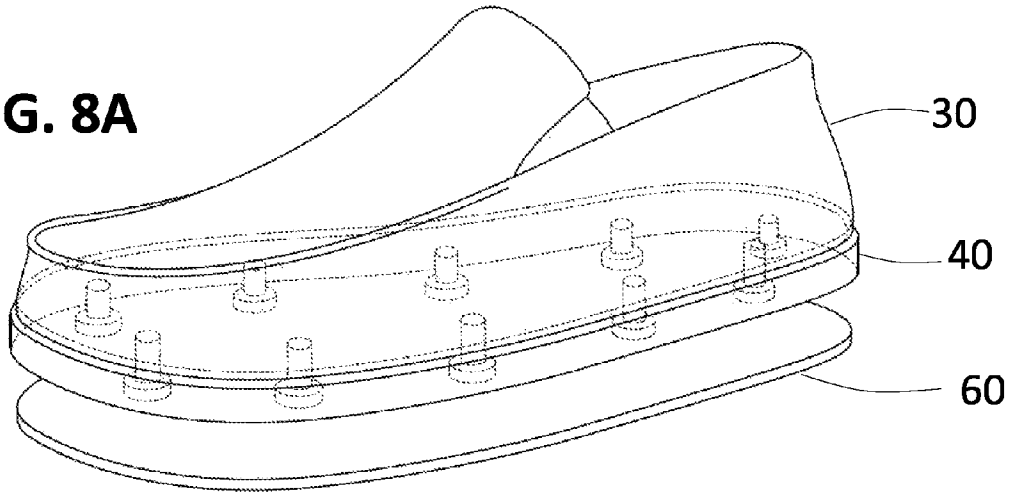
FIGS. 8A-8B illustrate an alternative construction for the shoe in accordance with the present invention.
Figure 8B:
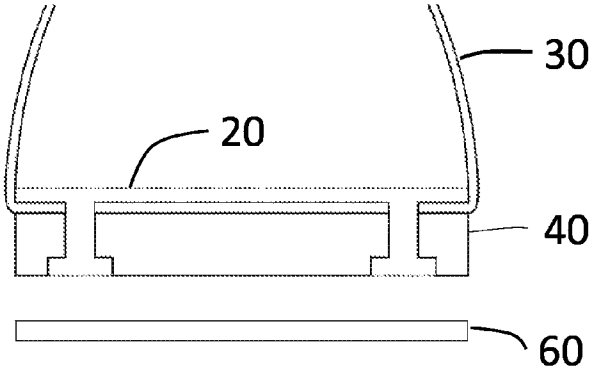

The foregoing construction and assembly is efficient and inexpensive, and can be used advantageously even if a supplemental outer sole, covering the bottom surfaces of the pegs and of the outer sole, is employed. With reference to FIGS. 8A-8B, supplemental outer sole 60, which should be durable, and preferably made of a material the same as or similar to the material selected for the out sole 40, may, if desired, be applied to the bottom surfaces of the pegs and of the outer sole through the use of a standard glue or sealant.

It will be appreciated that all of the foregoing constructions result in a shoe that is comfortable, lightweight, sturdy, durable, shock absorbent and breathable. It is produced using a manufacturing technique that is efficient, inexpensive, and, in the preferred embodiment, does not require the use of glues or sealants. The materials required to produce the shoe have been reduced and the amount of labor similarly reduced to thereby significantly shorten the production line process. Although glue or a sealant may be used to bind one or more of the three components to each other, such is not required in the assembly process, and thus production is safer, more consistent, does not require a cooldown process, and cuts down on highly toxic fumes, creating a better work environment.

The shoe produced in accordance with the present invention can employ a footwear upper of any conventional style and have an appropriate pull strength to accommodate multiple activities and durability. The inner sole/foot bed is shock absorbent, lightweight and comfortable.

Because of the efficiency in manufacturing, and minimal labor, the present invention drastically reduces production costs and increases quality. Furthermore, the shoe made in accordance with the present invention may be made of many different kinds of durable materials and will be lightweight and slip resistant. Exemplary materials for the upper include canvas, denim, leather, mesh, neoprene, polyurethane, suede, nubuck, cotton, woven mesh, polyurethane, and synthetic leather; exemplary materials for the inner sole include, rubber, thermoplastic rubbers, ethylene-vinyl acetate, blown ethylene-vinyl acetate, injected molded foam, injection molded rubber, plastic, and polyurethane; and exemplary materials for the outer sole (and supplemental outer sole, if desired), which can be die-cut or molded, include ethylene-vinyl acetate, thermoplastic rubbers, thermoplastic elastomers, blown ethylene-vinyl acetate, blown rubber, leather, injected molded foam, and injection molded rubber. Because the inner and outer soles can be made from the same or similar materials, it will be appreciated that the completed shoe can have a sole, formed by the outer sole and the pegs, that has substantially uniform characteristics throughout its extent. It should be noted that the foregoing materials are exemplary, and other materials may be selected by those skilled in the art to accomplish the goals of the invention set forth herein.

The foregoing preferred embodiments described herein are set forth as exemplary, and it will be appreciated that various modifications may be made without departing from the scope and spirit of the invention which is defined by the following claims.

I claim:

1. A shoe comprising:

a shoe upper having a first plurality of holes in a bottom surface of the shoe upper;

an outer sole having a second plurality of holes corresponding to the first plurality of holes; and an inner sole configured to be disposed within the shoe upper, the inner sole having a plurality of pegs extending from a bottom surface of the inner sole and arranged to concentrically align with the first plurality of holes and the second plurality of holes when the inner sole is disposed within the shoe upper, each peg extending downwardly into a respective one of the first plurality of holes and a respective one of the second plurality of holes, wherein a bottom surface of each peg forms part of a bottom surface of the shoe.

2. The shoe of claim 1, wherein the bottom surface of each peg is substantially co-planar with a bottom surface of the outer sole.

3. The shoe of claim 1, wherein each peg is configured in a substantially inverted 'T' shape, and each hole in the outer sole contains a on a bottom surface of the outer sole recess that is configured to receive a respective peg of the plurality of pegs, wherein each respective peg fits snuggly within said respective recess.

4. The shoe of claim 3 wherein said pegs and said recesses have a substantially circular cross-section.

5. The shoe of claim 3 wherein said pegs and said recesses have a substantially square cross-section.

6. The shoe of claim 3 wherein the upper, the inner sole and outer sole are substantially co-extensive.

7. The shoe of claim 1 wherein the outer sole has a width that extends from a medial sidewall of the shoe to a lateral sidewall of the shoe.

8. The shoe of claim 1 wherein the upper is comprised of a material selected from the group consisting of: canvas, denim, leather, mesh, neoprene, polyurethane, suede, nubuck, cotton, woven mesh, and synthetic leather.

9. The shoe of claim 1 wherein the inner sole is resilient and is formed of a material selected from the group consisting of: rubber, thermoplastic rubbers, ethylene-vinyl acetate, blown ethylene-vinyl acetate, injected molded foam, injection molded rubber, plastic, and polyurethane.

10. The shoe of claim 9 wherein the inner sole has at least one of the structures selected from the group consisting of; (i) cupped end portions, (ii) a contoured edge, (iii) an arch support region, (iv) massage beads, or (v) perforated knock-out holes.

11. The shoe of claim 1 wherein the outer sole is resilient and is formed of a material selected from the group consisting of: ethylene-vinyl acetate, thermoplastic rubbers, thermoplastic elastomers, blown ethylene-vinyl acetate, blown rubber, leather, injected molded foam, and injection molded rubber.

12. The shoe of claim 11 wherein the outer sole is die-cut.

13. The shoe of claim 11 wherein the outer sole is molded.

14. A shoe comprising:

a shoe upper having a first plurality of holes in a bottom surface of the shoe upper;

an outer sole having a second plurality of holes extending completely through the outer sole, the second plurality of holes corresponding to the first plurality of holes;

an inner sole configured to be disposed within the shoe upper, the inner sole having a plurality of pegs extending from a bottom surface of the inner sole and arranged to concentrically align with the first plurality of holes and the second plurality of holes when the inner sole is disposed within the shoe upper, each peg extending downwardly into a respective one of the first plurality of holes and a respective one of the second plurality of holes; and a supplemental outer sole applied to, and in contact with, a bottom surface of the outer sole and respective bottom surfaces of the plurality of pegs.

15. The shoe of claim 14, wherein each peg is configured in a substantially inverted 'T' shape, and each hole in the outer sole contains a recess on the bottom surface of the outer sole that is configured to receive a respective peg of the plurality of pegs, wherein each respective peg fits snuggly within said respective recess.

16. The shoe of claim 15 wherein the upper, the inner sole and outer sole are substantially co-extensive.

17. The shoe of claim 15 wherein the inner sole is resilient and is formed of a material selected from the group consisting of: rubber, thermoplastic rubbers, ethylene-vinyl acetate, blown ethylene-vinyl acetate, injected molded foam, injection molded rubber, plastic, and polyurethane.

18. The shoe of claim 15 wherein the outer sole is resilient and is formed of a material selected from the group consisting of: ethylene-vinyl acetate, thermoplastic rubbers, thermoplastic elastomers, blown ethylene-vinyl acetate, blown rubber, leather, injected molded foam, and injection molded rubber.

19. The shoe of claim 18 wherein the supplemental outer sole is comprised of the same material as the outer sole.

20. A shoe comprising:

a shoe upper having a first plurality of holes in a bottom surface of the shoe upper;

an outer sole having a second plurality of holes extending completely through the outer sole, the second plurality of holes corresponding to the first plurality of holes, the outer sole having a width that extends from a medial sidewall of the shoe to a lateral sidewall of the shoe;

an inner sole configured to be disposed within the shoe upper, the inner sole having a plurality of pegs extending from a bottom surface of the inner sole and arranged to concentrically align with the first plurality of holes and the second plurality of holes when the inner sole is disposed within the shoe upper, each peg extending downwardly into a respective one of the first plurality of holes and a respective one of the second plurality of holes; and a supplemental outer sole applied to a bottom surface of the outer sole.

* * * * *